US009510120B2

(12) United States Patent
John

(10) Patent No.: US 9,510,120 B2
(45) Date of Patent: Nov. 29, 2016

(54) APPARATUS AND METHOD FOR TESTING SOUND TRANSDUCERS

(71) Applicant: Amkor Technology, Inc., Chandler, AZ (US)

(72) Inventor: Gerard John, Chandler, AZ (US)

(73) Assignee: Amkor Technology, Inc., Tempe, AZ (US)

( * ) Notice: Subject to any disclaimer, the term of this patent is extended or adjusted under 35 U.S.C. 154(b) by 347 days.

(21) Appl. No.: 14/066,767

(22) Filed: Oct. 30, 2013

(65) Prior Publication Data

US 2015/0117654 A1 Apr. 30, 2015

(51) Int. Cl.
*H04R 29/00* (2006.01)
*H04R 19/00* (2006.01)

(52) U.S. Cl.
CPC ..... *H04R 29/004* (2013.01); *H04R 19/005* (2013.01); *H04R 2499/11* (2013.01)

(58) Field of Classification Search
CPC .... H04R 11/02; H04R 25/30; H04R 29/004; H04R 29/001; H04R 1/025; H04R 25/606; H04R 25/70; H04R 2460/13; H04R 2225/67; H04R 19/005; H04R 2499/11; H04R 2499/13; H04R 29/002; H04R 5/02
USPC ..... 379/60, 59, 58, 96; 381/60, 59, 151, 381/326, 56, 58
See application file for complete search history.

(56) References Cited

U.S. PATENT DOCUMENTS

| | | | | |
|---|---|---|---|---|
| 2,530,383 | A | 11/1950 | Estes et al. | |
| 4,771,476 | A * | 9/1988 | Ryback | A61B 7/02 381/338 |
| 7,385,408 | B1 | 6/2008 | Adney et al. | |
| 7,781,249 | B2 | 8/2010 | Laming et al. | |
| 7,839,136 | B1 | 11/2010 | John | |
| 8,237,460 | B1 | 8/2012 | Park et al. | |
| 8,358,787 | B2 | 1/2013 | Lee et al. | |
| 2004/0152998 | A1 * | 8/2004 | Stott | A61B 5/742 600/559 |
| 2006/0142062 | A1 * | 6/2006 | Eder | H04B 1/3877 455/557 |
| 2007/0286429 | A1 | 12/2007 | Grafenberg et al. | |
| 2010/0155864 | A1 | 6/2010 | Laming et al. | |
| 2010/0215183 | A1 * | 8/2010 | Hansson | H04R 1/1033 381/58 |
| 2010/0219839 | A1 | 9/2010 | Steele et al. | |
| 2012/0266021 | A1 * | 10/2012 | Tian | G06F 11/2733 714/27 |
| 2013/0083935 | A1 * | 4/2013 | Yang | H04R 29/00 381/58 |
| 2013/0340530 | A1 * | 12/2013 | Oberdoerfer | G01N 29/2487 73/632 |
| 2014/0079229 | A1 * | 3/2014 | Doller | B81C 99/0045 381/58 |
| 2014/0328489 | A1 * | 11/2014 | Ziegler | H04R 29/004 381/58 |

* cited by examiner

*Primary Examiner* — Akelaw Teshale
(74) *Attorney, Agent, or Firm* — Kevin B. Jackson

(57) ABSTRACT

In one embodiment, an apparatus for testing sound transducers includes a test socket having at least one acoustic generator and at least one sound monitoring device integrated therein. In one embodiment, the test socket includes a well for holding the sound transducer during test, the well being in communication with the at least one acoustic generator and the at least one sound receiving device.

20 Claims, 4 Drawing Sheets

APPARATUS AND METHOD FOR TESTING SOUND TRANSDUCERS

CROSS REFERENCE TO RELATED APPLICATIONS

Not applicable.

BACKGROUND

The present invention relates to electronic testing apparatus, and more particularly to an integrated test socket apparatus that is configured to test sound transducers, and a method of using the same.

Consumer electronics devices are continually getting smaller and, with advances in technology, are gaining ever increasing performance and functionality. This is clearly evident in the technology used in consumer electronic products such as smart phones, laptop computers, tablet devices, wearable devices, as well as other electronic devices. Requirements of the smart phone industry, for example, are driving components to become smaller with higher functionality and reduced cost. Smart phones now require multiple microphones for noise cancelling, or accelerometers to allow inertial navigation, while maintaining or reducing the small form factor and aiming at a similar total cost to previous generation phones. This has encouraged the emergence of miniature sound transducers. With respect to speech applications, initially electric condenser or moving coil elements were used in microphones to capture speech, but more recently micro-electrical-mechanical (MEMS) sound transducers have been introduced.

Traditional MEMS sound transducers are capacitive transducers, which typically comprise one or more membranes with electrodes for read-out. Relative movement of these electrodes modulates the capacitance between them, which then has to be detected by associated electronic circuitry such as sensitive electronic amplifiers.

MEMS sound transducers typically are manufactured in wafer form and then separated into individual die after manufacturing is completed. Each MEMS die is then assembled into a protective package structure, which typically comprises a substrate that the MEMS die is attached to. The substrate may also include an associated electronic analog amplifier and an additional analog-to-digital converter in the case of digital microphones. Conductive structures such as wire bonds are used to connect the MEMS dies to the electronic circuitry on the substrate, which facilitates passing of electrical signals out of the MEMS structure. A molded plastic housing or a metal can lid or an encapsulating layer is then attached or formed to protect the MEMS die, conductive wires and associated circuitry from damage caused by handling the device. A port or passage in the housing or molded layer allows the MEMS sound transducer to measure sound waves by changes in air pressure, which is then converted to an electrical signal.

After assembly, the MEMS sound transducers are then tested by attaching them to test boards using test sockets. In the past, the test boards were then placed inside a sound chamber apparatus, which provided the sound stimulus to test the devices to make sure they met predetermined electrical specifications. Several problems existed with this prior approach including the high cost of the sound chambers. The sound chambers were custom built and hand assembled, which caused large unit-to-unit variation. Also, the sound chambers tended to be bulky and their large size increased the possibility for the existence of multi-path signals, which further limited the ability to provide uniform sound intensities within the sound chamber and thus, limited the number of devices that could be tested at one time. Additionally, the bulky sound chambers typically did not integrate well into standard robotic device handlers and therefore required custom handler design to accommodate them. Finally, Outsourced Assembly and Test (OSAT) companies typically preferred to purchase equipment that was generic and that could be reused when a device comes to its end of life rather than application specific equipment tailored to one device type, which was typically the case with previous sound chamber designs.

Accordingly, it is desirable to have an apparatus and method that improves the testing of sound transducers such as MEMS microphones and provides flexibility to the OSAT. Further, it is desirable that such apparatus be cost effective, facilitate the testing of multiple devices, and measure the sound stimulus in real time while using existing device handling equipment.

For simplicity and clarity of the illustration, elements in the figures are not necessarily drawn to scale, and the same reference numbers in different figures denote the same elements. Additionally, descriptions and details of well-known steps and elements are omitted for simplicity of the description.

DETAILED DESCRIPTION OF THE DRAWINGS

The aspects of the present invention and methods for achieving the aspects will be apparent by referring to the embodiments to be described herein with reference to the accompanying drawings. It is understood that the embodiments described herein are illustrative only and that the present invention is not limited thereto, but can be implemented in alternative forms.

In accordance with the present embodiments, a test apparatus includes a test socket having an acoustic driver and a reference microphone integrated therein. The test socket includes a test well configured to hold a sound transducer (henceforth may also be referred to as a device under test or DUT) and to provide electrical contact thereto. An external tester can be configured to control the integrated acoustic driver that generates the test tones, which are the stimulus to the DUT, while the integrated reference microphone is configured to provide a real time monitor of the amplitude and frequency of the test tones applied to the DUT. In one embodiment, the test socket is configured to hold a plurality of DUT's, a plurality of acoustic drivers, and a plurality of reference microphones.

In another embodiment, the present description pertains to a method for testing one or more DUT's. The method includes placing a DUT onto a test socket that has an integrated or dedicated sound generator configured as the stimulus to the DUT. In one embodiment, the test socket also includes an integrated or dedicated reference device, such as a reference microphone. The method includes applying a sound wave or sound pressure to the sound transducer using the integrated sound generator and monitoring the sound pressure with the integrated reference device.

Figure 1:
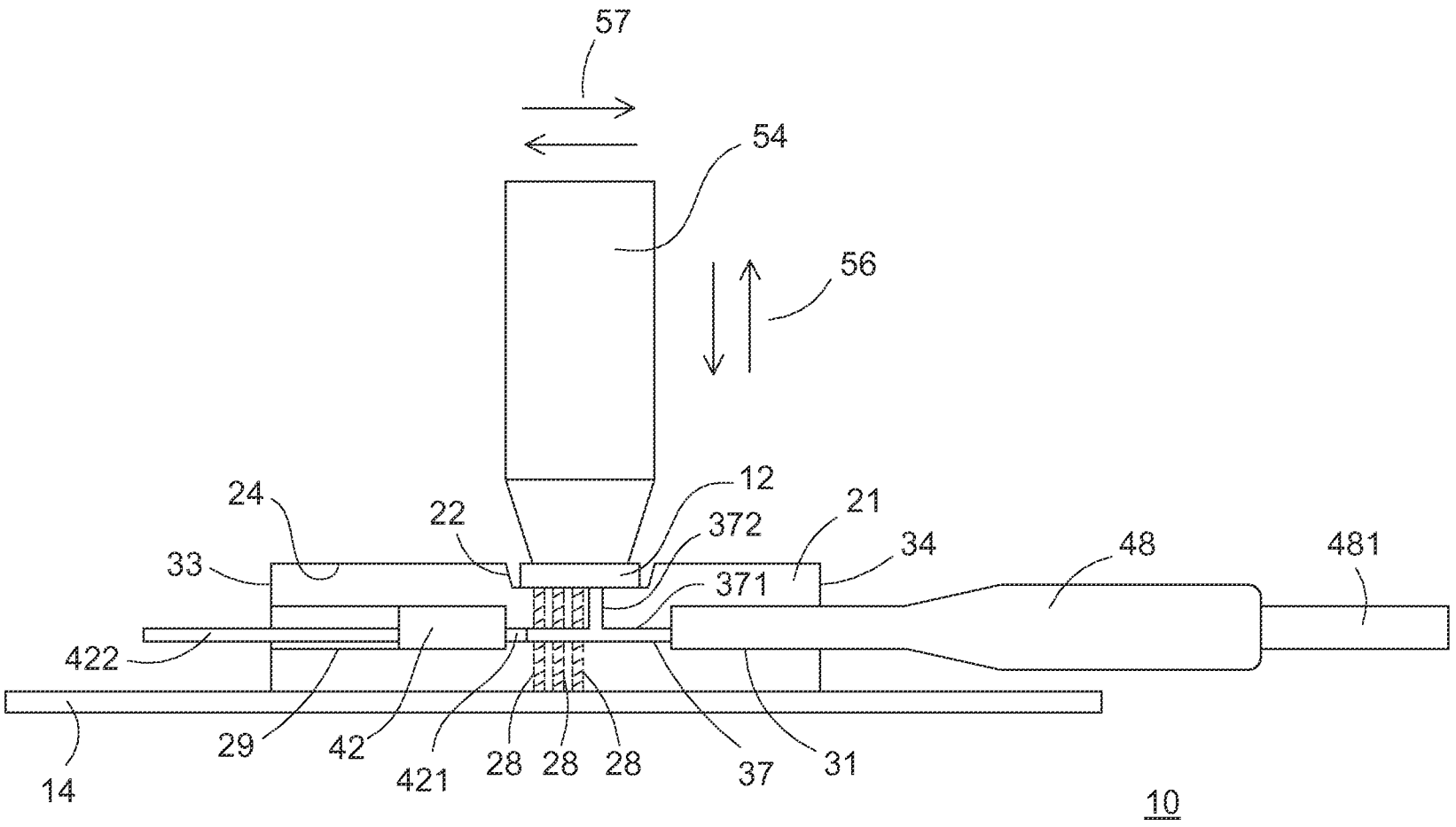
FIG. 1 illustrates a cross-sectional view of a test apparatus according to an embodiment of the present invention.

FIG. 1 illustrates a cross-sectional view of a test apparatus, assembly, or arrangement 10 in accordance with a first embodiment. In accordance with the present embodiment, test apparatus 10 is configured for testing a sound transducer or DUT 12. In one embodiment, sound transducer 12 can be a micro-machined or MEMS microphone. In another embodiment, sound transducer 12 can be a non-MEMS microphone. Apparatus 10 is illustrated to include a test board 14. In one embodiment, test board 14 can be a printed circuit board ("PCB") that is configured with conductive traces on one or more layers, and is further configured to interface with automated test equipment (not shown) using, for example, an interconnect socket or connector. The test equipment provides input signals to apparatus 10 and measures output signals from sound transducer 12 during a selected or predetermined test procedure or protocol.

In accordance with the present embodiment, a test socket 21 is attached to test board 14. In one embodiment, test socket 21 can be a machined work piece configured to accommodate one or more sound transducers 12. In one embodiment, test socket 21 is machined from a solid piece of material using, for example, an automated milling machine tool, such as a CNC tool, to form the machined work piece. In one embodiment, test socket 21 can include a well, recessed well, or recessed portion 22 in an upper surface 24. In one embodiment, well 22 can be configured with sloped sidewalls to facilitate the loading of sound transducer 12. Test socket 21 can made of a metal, metal alloy, ceramic, polymer, plastic, combinations thereof, a rigid material, or other materials as known to those of ordinary skill in the art. Specifically, test socket 21 can comprise one or more rigid materials conducive to passing sound waves with minimal losses or interference.

Test socket 21 can further include one or more electrical contact structures 28 that are configured to carry electrical signals to and/or from sound transducer 12 during a test procedure. In one embodiment, electrical contact structures 28 can be spring loaded pins that compress when sound transducer 12 is pushed into well 22 to provide electrical contact between sound transducer 12 and test board 14. One advantage of the present embodiment is that spring loaded pins (also referred to as "pogo" pins) provide good electrical contact without the need for a permanent electrical bond, such as soldering, and test socket 21 can become an integral part of the test apparatus. This further reduces the cycle-time necessary to test sound transducer 12.

In one embodiment, test socket 21 further includes passages, bores, ducts, or conduits 29 and 31 that can extend from opposite sidewalls 33 and 34 respectively. As illustrated, passage 29 extends inward from sidewall 33 towards a central portion of test socket 21, and passage 31 extends inward from sidewall 35 towards the central portion. In one embodiment, passages 29 and 31 are in communication through a passage or sound channel 37, which is configured to include a generally horizontal portion 371 and a generally vertical portion 372 that extends from portion 371 to well 22. Portion 372 is further configured to provide an audio path with the transducer portion of sound transducer 12 when sound transducer 12 is inserted into test socket 21. Specifically, portions 371 and 372 are configured to pass sound waves to sound transducer 12. Passages 29, 31, and 37 can be formed using machining techniques. In one embodiment, passage 37 has cross-sectional shapes configured to minimize any detrimental effects on sound during test. In one embodiment, passage 27 has a generally round, rounded, or circular cross-sectional shape. In one embodiment, passage 29 can have a generally square or rectangular cross-sectional shape. In one embodiment, passage 31 can have a generally round, rounded or circular shape. Specifically, passages 29 and 31 have cross-sectional shapes configured to accommodate the placement of additional components as described hereinafter.

In accordance with one embodiment, a sound generating device, sound generator, acoustic driver, or sound driver 42 is incorporated within passage 29. In one embodiment, sound drive 42 can be demountably secured within passage 29 using, for example, an adhesive material or an adhesive tape or film. In one embodiment, the outer diameter of sound driver 42 is approximate to but slightly less than the diameter of passage 29 to provide for a secure fit. In another embodiment, a material can be placed within passage 29 to hold sound drive 42 in place and to provide sound dampening. In one embodiment, the material can be foam plug.

In one embodiment, sound driver 42 is secured in such a way so as to facilitate efficient removal for maintenance or replacement. Sound driver 42 is illustrated with a speaker or sound output portion 421 that can be placed within portion 371 of passage 37. In one embodiment, the diameter of sound output portion 421 is approximate to but slightly less than the diameter of a passage 37 to provide secure fit. Sound driver 42 is further illustrated with a cable or electrical connection device 422 for connecting sound driver 42 to, for example, a control device (not shown) that can be part of the automated test equipment. In one embodiment, sound driver 42 can be an acoustic speaker such as a subminiature speaker available from Knowles Electronics of Itasca, Ill., U.S.A.

A sound receiver, sound receiving device, microphone, or microphone device 48 is incorporated within passage 31. In accordance with the present embodiment, microphone 48 is configured as a reference microphone and further includes a cable or electrical connection device 481 for connecting microphone 48 to a control device (not shown) that can be part of the automated test equipment. In one embodiment, microphone 48 can be demountably secured within passage 31 using, for example, an adhesive material or an adhesive tape or film. In one embodiment, the outer diameter of microphone 48 is approximate to but slightly less than the diameter of passage 31 to provide for a secure fit. In one embodiment, microphone 48 can be secured in such a way so as to facilitate efficient removal for maintenance or replacement. In one embodiment, sound receiver 48 can be a microphone such as a reference microphone available from G.R.A.S. Sound & Vibration of Holt, Denmark.

In accordance with one embodiment, passage 37 is configured so that the distance from sound output portion 421 to sound transducer 12 is substantially equal to the distance from sound output portion 421 to microphone 48. In one embodiment, passage 37 (including portions 371 and 372) is configured so that sound transducer 12 and microphone 48 are substantially equidistant from sound output portion 421. This provides, among other things, a configuration where microphone 48 provides a more optimum reference for the device under test. Specifically, the present embodiment adds functionality to test socket 21 with the addition of source driver 42 and microphone 48, which provides a real time monitor of the sound pressure level and frequency applied to the DUT, such as sound transducer 12. This is an improvement over prior microphone test systems that utilized large sound chambers. By integrating the sound generator and the reference microphone with the test socket, an increase in the functionality of the test socket is achieved by not only providing electrical contact, but also providing the sound stimulus that excites the sound transducer under test and provides a structure that monitors the sound pressure level applied to the sound transducer under test by means of the reference microphone.

Test apparatus 10 is further illustrated with a device handler structure 54, which can be configured to transport sound transducer 12 to test socket 21 for testing. As illustrated, device handler 54 can be configured for vertical movement (generally represented by arrows 56) and lateral movement (generally represented by arrows 57). Device handler 54 can be further configured to a provide a predetermined downward force onto sound transducer 12 to better ensure electrical contact between sound transducer 12 and electrical contact structure 28 during testing. Device handler 54 can be further configured to include a means to reversibly hold sound transducer 12 using, for example, a vacuum.

Figure 2:
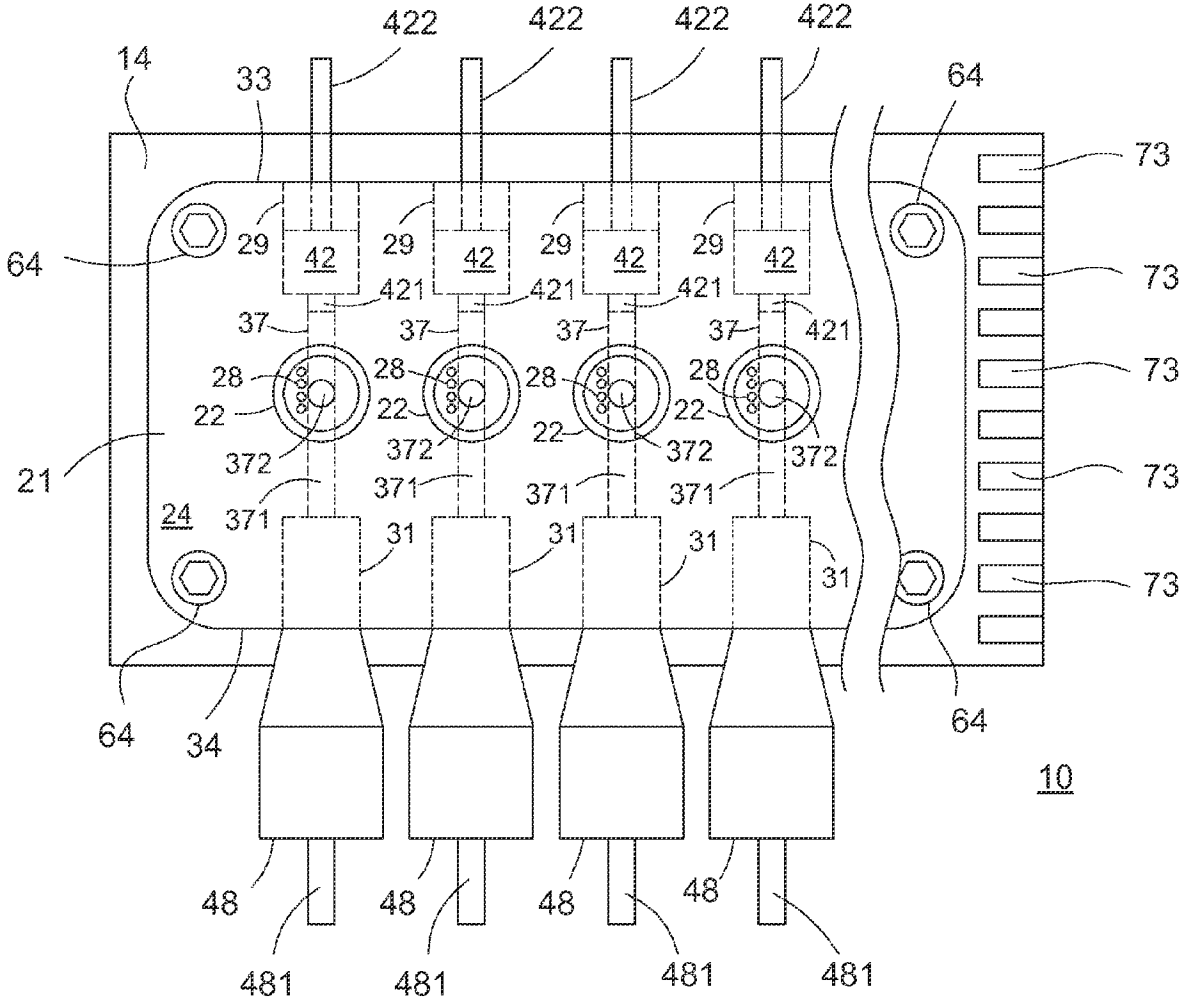
FIG. 2 illustrates a top view of a test socket apparatus in accordance with an embodiment the present invention.

FIG. 2 illustrates a top view of test apparatus 10 in accordance with one embodiment. Test board 14 is illustrated with a plurality of conductive contacts 73, which can be configured for plugging into a test fixture as part of an automated test system. In this embodiment, test socket 21 is illustrated with a plurality (i.e., more than one) well portions 22 for holding a plurality of (i.e., more than one) sound transducers 12 within test apparatus 10. Test apparatus 10 is further illustrated with a plurality of sound generators 42 and reference microphones 48. In another embodiment, sound generators 42 and reference microphones can be electrically connected directly to test board 14 and contacts 73.

In one embodiment, each well portion 22 is in communication with passages 29, 31, and 37 through portion 372. Each well portion 22 is further illustrated with electrical contact structures 28, which can be electrically connected to contacts 73 on test board 14. By way of example, electrical contact structures 28 can be electrically connected to contacts 73 by conductive traces embedded in test board 14. By way of example, test socket 21 can be attached to test board 14 using bolts 64. One advantage of the present embodiment is that a plurality of sound transducers 12 can be tested in a very compact footprint compared to previous sound chamber configurations. This reduced footprint allows for higher parallelism thus increasing the throughput and lowering testing costs. Also, with the integrated sound generator and reference device being dedicated to a single device under test, improved testing is achieved compared to test apparatus using sound chambers where variations can occur depending on where the devices under test are located.

Figure 3:
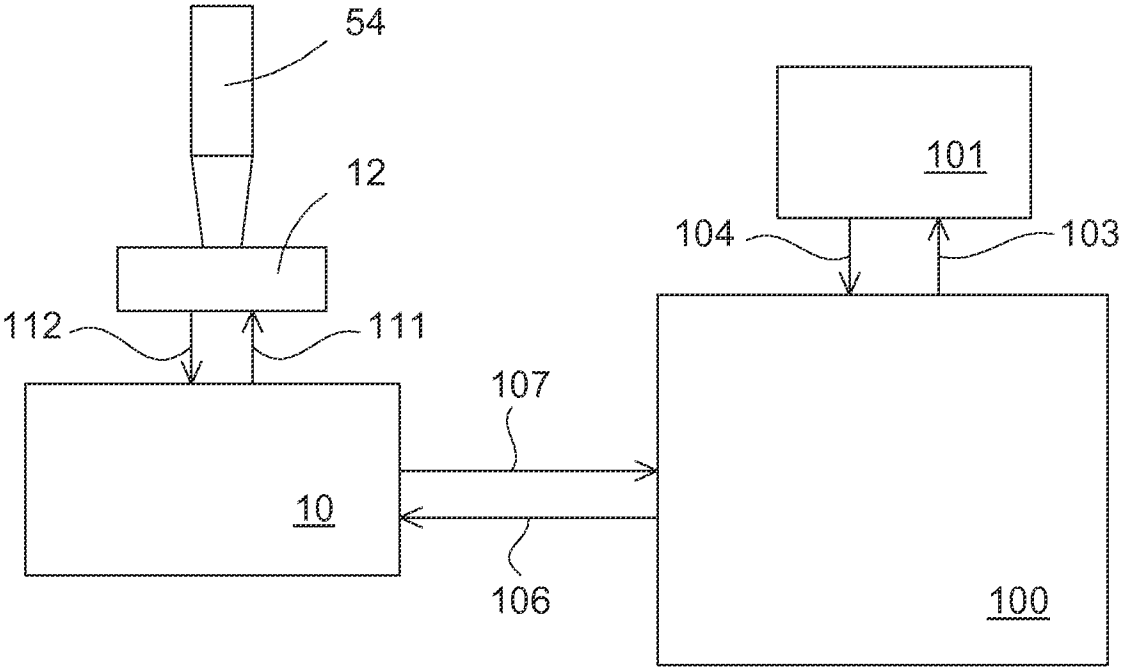
FIG. 3 illustrates a generalized block diagram of a test system incorporating an embodiment of the test apparatus of the present invention.

FIG. 3 illustrates a generalized block diagram of a test system utilizing a test apparatus in accordance with one embodiment. Automated test equipment ("ATE") device 100 is in electrical communication (represented generally by arrows 103 and 104) with interface device 101, which can be configured, for example, to load test programs and retrieve test data. ATE device 100 is in further electrical communication (represented generally by arrows 106 and 107) with test apparatus 10 as described previously. In one embodiment ATE device 100 can be connected to contacts 73 on test board 14 using, for example, a socket connector or cable connector. Sound transducer or DUT 12 is loaded into test apparatus 10 (using, for example, device handler 54) and sound pressure can be applied (represented generally by arrow 111) to sound transducer 12 using a sound generator (for example, sound generator 42) integrated within the test socket portion (for example, test socket 21) of test apparatus 10 in accordance with the present embodiment. Electrical signals are then transmitted (represented generally by arrow 112) from sound transducer 12 to ATE device 100 through test apparatus 10. The reference microphone (for example, microphone 48) integrated with test apparatus 10 in accordance with the present embodiment provides real-time sound pressure monitoring feedback for improved test results. It is understood that multiple test apparatus 10 (each capable of accommodating multiple DUT's) can be connected to ATE device 100 for higher volume testing.

Figure 4:
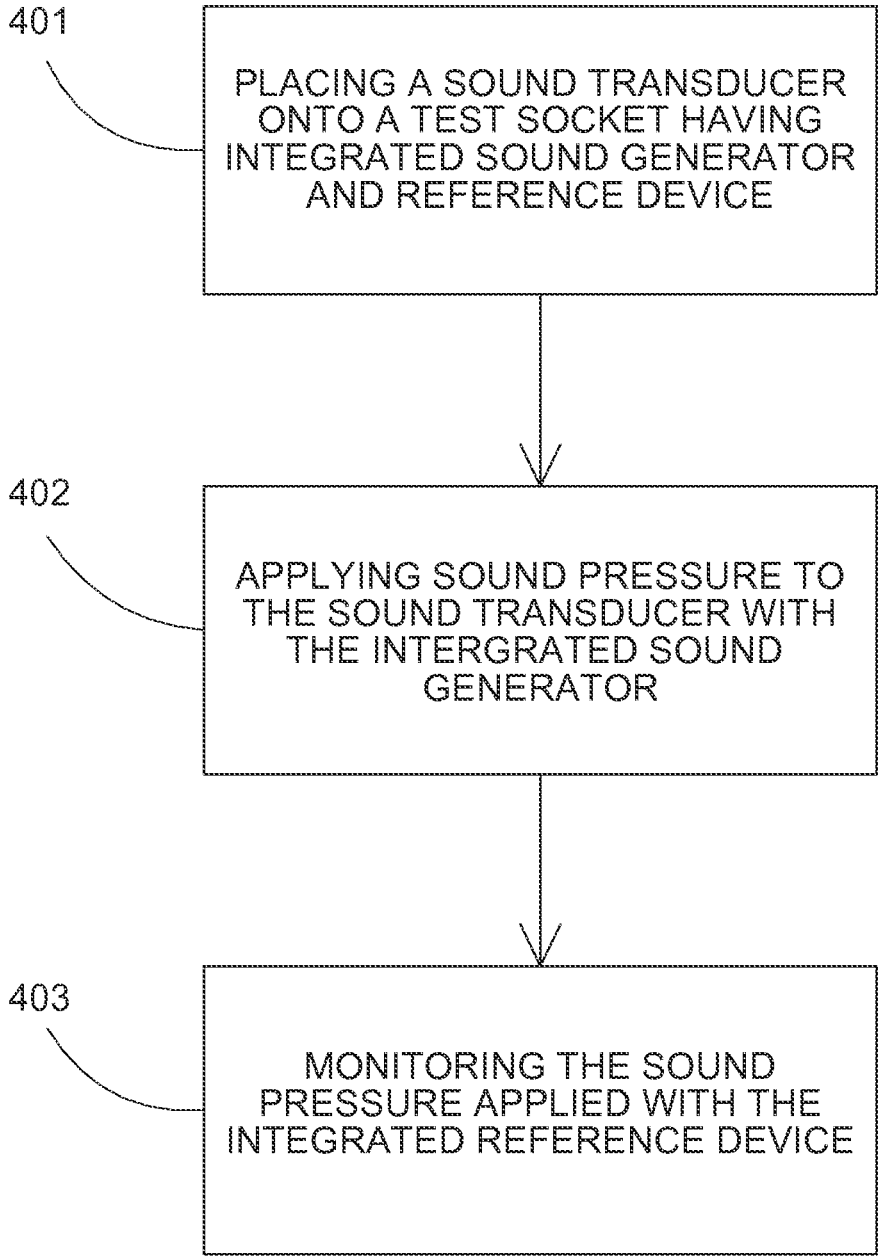
FIG. 4 illustrates a flow diagram a method for testing an electronic device in accordance with an embodiment of the present invention.

FIG. 4 illustrates a generalized flow diagram of a test method in accordance with one embodiment. In step 401, the DUT, such as a sound transducer 12, is placed on, within, or onto a test socket, such as test socket 21, which can be part of test apparatus 10 and ATE device 100 as described previously. In one embodiment, the test socket includes an integrated sound or acoustic generator, such as sound generator 42. In one embodiment, the test socket includes an integrated reference device, such as reference microphone 48. In one embodiment, the integrated sound generator and reference device are dedicated to a single sound transducer or DUT. In one embodiment, an automated handling device, such as device handler 54, can be used to place the sound transducer onto the test socket. The sound transducer is electrically connected to an ATE device using, for example, electrical connect structures 28, which can be conductive spring actuated pins or pogo pins. In one embodiment, the test socket is attached to a test board, such as test board 14, and is electrically connected to the ATE device.

In step 402, a sound wave or sound pressure is applied to the sound transducer from the sound generator. In one embodiment, the sound pressure is transmitted through a passage in the test socket to the sound transducer, which senses the sound pressure and produces an electrical signal. The electrical signal from the sound transducer can be transmitted through the electrical connect structures from the test socket to the ATE device for measurement. In one embodiment, the sound pressure is further monitored by the reference device as set forth in step 403. In one embodiment, the reference device produces an output signal that can be measured by the ATE device as a reference signal representing the characteristics of sound wave produced by the sound generator and received by the sound transducer under test. The method can be further used to calibrate the sound transducer through, for example, a trimming process.

From all of the foregoing, one skilled in the art can determine that, according to one embodiment, an apparatus for testing a sound transducer includes a test socket (for example, element 21) configured to hold a first sound transducer (for example, element 12). A first sound generator (for example, element 42) is incorporated into the test socket and configured to be in communication (for example, elements 37, 371, 372) with the first sound transducer. A first sound receiving device (for example, element 48) is incorporated into the test socket and configured to monitor output of the first sound generator.

From all of the foregoing, one skilled in the art can determine that, according to another embodiment, an apparatus for testing electronic devices comprises a socket (for example, element 21) configured to hold a plurality of electronic devices (for example, element 12). A plurality of drivers (for example, element 42) is incorporated into the test socket, each driver configured to be in communication with one electronic device. A plurality of receivers (for example, element 48) is incorporated into the socket, each receiver configured to monitor output of one driver.

From all of the foregoing, one skilled in the art can determine that, according to a further embodiment, a method for testing a sound transducer comprises placing (for example, element 401) a sound transducer (for example, element 12) onto a test socket (for example, element 21), the test socket having a acoustic generator (for example, element 42) and a sound receiving device (for example, element 48) integrated therein, wherein the acoustic generator is in communication with the first sound transducer through a passage (for example, elements 37, 371, 372) in the test socket. The method includes applying sound pressure (for example, element 402) from the acoustic generator to the sound transducer. The method includes monitoring the sound pressure (for example, element 403) with the sound receiving device.

In view of all the above, it is evident that a novel structure and method is disclosed. Included, among other features, is a test apparatus that includes a test socket having an integrated sound generator and an integrated reference device. In one embodiment, the test socket includes a well region for receiving a sound transducer for testing with the well in communication with the integrated sound generator. The test apparatus adds desired functionality to the test socket with the addition of the sound generator and reference device, which can be dedicated to an individual device under test. In one embodiment, the test socket is configured to integrate a plurality of sound generators and reference devices, which can each be dedicated to an individual device under test to improve throughput. The test socket and method reduces the footprint of the test apparatus and improves the cycle and accuracy of device testing.

While the subject matter of the invention is described with specific preferred embodiments and example embodiments, the foregoing drawings and descriptions thereof depict only typical embodiments of the subject matter and are not, therefore, to be considered limiting of its scope. It is evident that many alternatives and variations will be apparent to those skilled in the art.

As the claims hereinafter reflect, inventive aspects may lie in less than all features of a single foregoing disclosed embodiment. Thus, the hereinafter expressed claims are hereby expressly incorporated into this Detailed Description of the Drawings, with each claim standing on its own as a separate embodiment of the invention. Furthermore, while some embodiments described herein include some but not other features included in other embodiments, combinations of features of different embodiments are meant to be within the scope of the invention and form different embodiments, as would be understood by those skilled in the art.

What is claimed is:

1. An apparatus for testing a sound transducer comprising:

a test socket having a first major surface and a sidewall surface, the first major surface being configured to hold a first sound transducer, the test socket further comprising:

a first passage;

a second passage spaced apart from the first passage; and a sound channel extending between the first passage, the second passage, and the first major surface, the sound passage configured to pass sound waves;

a first sound generator disposed within the first passage and configured to be in communication with the first sound transducer; and a first sound receiving device disposed within the second passage and configured to monitor output of the first sound generator through the sound channel.

2. The apparatus of claim 1, wherein the test socket has a second major surface opposite to the first major surface, the apparatus further comprising a plurality of electrical connect structures extending from the first major surface to the second major surface.

3. The apparatus of claim 2, wherein the electrical connect structure comprises spring-loaded pins.

4. The apparatus of claim 1, wherein the test socket includes a recessed well disposed in the first major surface configured for holding the first sound transducer.

5. The apparatus of claim 1, wherein the first sound receiving device comprises a microphone.

6. The apparatus of claim 1, wherein the test socket is configured so that the first sound transducer and the first sound receiving device are substantially equidistant from the first sound generator when the first sound transducer is under test.

7. The apparatus of claim 1 further comprising a test board, wherein the test socket is coupled to the test board, and wherein the test board is configured for connecting the apparatus to an automated test device.

8. The apparatus of claim 1 further comprising:

a second generator incorporated into the test socket and configured to be in communication with a second sound transducer; and a second sound receiving device incorporated into the test socket and configured to monitor output of the second sound generator.

9. The apparatus of claim 1, wherein:

the first passage is disposed extending inward from a first portion of the sidewall surface, the second passage is disposed extending inward from a second portion of the sidewall surface; and the sound channel comprises a generally horizontal portion extending between the first passage and the second passage and a generally vertical portion extending between the generally horizontal portion and the first major surface of the test socket.

10. The apparatus of claim 9, wherein the sound channel has a generally circular cross-sectional shape, and wherein the second portion of the sidewall surface is opposite to the first portion of the sidewall surface.

11. An apparatus for testing an electronic device having a sound transducer comprising:

a socket configured to hold the electronic device, the socket having a sound passage configured to pass sound waves;

a sound driver disposed within a first passage in the socket, the sound driver configured to be in audio communication with the electronic device through the sound passage; and a sound receiver disposed within a second passage in the socket, the sound receiver configured to monitor audio output of the sound driver through the sound passage.

12. The apparatus of claim 11, wherein:

the socket comprises a first major surface configured to hold the electronic device and a sidewall surface;

the first passage is disposed extending inward from a first portion of the sidewall surface, the second passage is disposed extending inward from a second portion of the sidewall surface;

the sound passage comprises a generally horizontal portion extending between the first passage and the second passage and a generally vertical portion extending between the generally horizontal portion and the first major surface of the socket; and the sound passage is configured such that a surface of the electronic device and the sound receiver are substantially equidistant from the sound driver when electronic device is under test.

13. The apparatus of claim 11 further comprising a plurality of electrical connect devices within the socket configured to carry electrical signals to and from the electronic device.

14. The apparatus of claim 11 further comprising a test board, wherein the socket is coupled to the test board.

15. The apparatus of claim 11, wherein the socket comprises a machined work piece.

16. A method for testing a sound transducer comprising:

placing a sound transducer onto a test socket, the test socket having an acoustic generator and a sound receiving device integrated therein, wherein the acoustic generator is in audio communication with the sound transducer through an audio passage in the test socket;

applying sound pressure from the acoustic generator to the sound transducer through the audio passage; and monitoring the sound pressure with the sound receiving device.

17. The method of claim 16, wherein placing the sound transducer comprises placing the sound transducer within a well of the test socket, the test socket further comprising at least one electrical connect structure for carrying electrical signals between the sound transducer and a test system.

18. The method of claim 17 further comprising measuring electrical signals from the sound transducer.

19. The method of claim 16 further comprising applying a downward force to the sound transducer.

20. The method of claim 16, wherein placing the sound transducer comprises placing a micro-machined microphone, and wherein placing the micro-machined microphone comprises placing the micro-machined microphone onto the test socket, wherein the audio passage is configured such that the micro-machined microphone and the sound receiving device are substantially equidistant from the acoustic generator.

* * * * *